US005211882A

United States Patent [19]

Tagata et al.

[11] Patent Number: 5,211,882

[45] Date of Patent: May 18, 1993

[54] DETERGENT COMPOSITIONS CONTAINING AN N-ALKYLAMINO SULFONIC ACID TYPE SURFACTANT AND NONIONIC SURFACTANT

[75] Inventors: Shuji Tagata, Kaminokawa; Fumio Sai, Utsunomiya, both of Japan

[73] Assignee: Kao Corporation, Tokyo, Japan

[21] Appl. No.: 588,830

[22] Filed: Sep. 27, 1990

[30] Foreign Application Priority Data

Oct. 6, 1989 [JP] Japan ..... 1-261749

[51] Int. Cl.[5] ..... C11D 1/28; C11D 1/83; C11D 1/831

[52] U.S. Cl. ..... 252/545; 252/550; 252/552; 252/559; 252/174.21; 252/174.22

[58] Field of Search ..... 252/545, 552, 550, 174.21, 252/174.22, 559

[56] References Cited

U.S. PATENT DOCUMENTS 3,198,814 8/1965 Mannheimer et al. ..... 252/545

3,198,815 8/1965 Mannheimer et al. ..... 252/545

FOREIGN PATENT DOCUMENTS 0374702 6/1990 European Pat. Off. .

2349293 4/1975 Fed. Rep. of Germany .

3337026 4/1985 Fed. Rep. of Germany .

2094335 9/1982 United Kingdom .

2219595 12/1989 United Kingdom .

OTHER PUBLICATIONS

English translation of DE 2,349,293 (Henkel) Apr. 1975.

*Primary Examiner*—Paul Lieberman

*Assistant Examiner*—Erin Higgins

*Attorney, Agent, or Firm*—Oblon, Spivak, McClelland, Maier & Neustadt

[57] ABSTRACT

A detergent composition which has an excellent detergency against muddy dirt of clothing which comprises (a) nonionic surfactant and (b) N-alkylamino sulfonate with weight ratio of (a) to (b) in the range of 1/10 to 10/1.

4 Claims, No Drawings

DETERGENT COMPOSITIONS CONTAINING AN N-ALKYLAMINO SULFONIC ACID TYPE SURFACTANT AND NONIONIC SURFACTANT

BACKGROUND OF THE INVENTION

1. Field of the Invention

The present invention relates to a detergent composition, particularly to a detergent composition which has an excellent detergency against clothing stained with inorganic dirt.

2. Description of the Prior Art

Clothing dirt can be divided mostly into a) organic dirt and b) inorganic dirt. The organic dirt consists mainly of sebaceous dirt from the human body in the case of clothing such as underwear. A detergent composition comprising nonionic surfactant has an excellent detergency against oily dirt such as sebaceous dirt.

On the other hand, the inorganic dirt consists mainly of mud originated from dust suspended in the air or soil. In general, clothing dirt or stain is a mixture of the organic dirt and the inorganic dirt.

Up to the present, various studies have been conducted in order to enhance the detergency against the inorganic dirt.

For example, Japanese Laid-Open Nos. 54-39411 and 54-130509 disclose a combined use of certain water soluble cationic surfactants. Japanese Laid-Open Nos. 51-112489 and 56-150048 disclose a combined use of certain amphoteric surfactants. Japanese Laid-Open No. 53-104582 discloses a combined use of carboxy alkylated alkylether-type anionic surfactants.

However, the detergents mentioned above do not have sufficient detergency against the inorganic dirt, especially against mud stuck on socks, etc.

SUMMARY OF THE INVENTION:

The present inventors have made intensive studies on the detergent compositions to solve the problem mentioned before and, as a result, found that a detergency against muddy dirt can be remarkably improved by using both certain N-alkylamino sulfonate type-surfactant and nonionic surfactant as ingredients of a detergent composition. The present invention was accomplished based on the above findings.

Accordingly, the present invention provides for a detergent composition comprising (a) nonionic surfactant and (b) N-alkylamino sulfonic acid type surfactant having the formula (I).

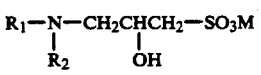

(I)

wherein $R_1$ represents $C_6$–$C_{18}$ alkyl, alkenyl or hydroxyalkyl, $R_2$ represents hydrogen, $C_1$–$C_{18}$ alkyl, alkenyl, hydroxyalkyl or $-(CH_2CH_2O)_n-H$ group (n is an integer of from 1 to 10), and M represents alkali metal, alkaline earth metal and a weight ratio of (a) to (b) is in the range of 1/10 to 10/1.

DETAILED DESCRIPTION OF THE INVENTION AND PREFERRED EMBODIMENT

Although nonionic surfactants of the (a) component of the invention are not limited specifically, the following compounds are illustrated for purposes of exemplification.

(1) Polyoxyethylene alkyl or alkenyl ether having $C_{10}$–$C_{20}$ (average) alkyl or alkenyl group, and added with 1–20 moles of ethylene oxide.

(2) Polyoxyethylene alkylphenyl ether having $C_6$–$C_{12}$ (average) alkyl group, and added with 1–20 moles of ethylene oxide.

(3) Polyoxypropylene alkyl or alkenyl ether having $C_{10}$–$C_{20}$ (average) alkyl or alkenyl group, and added with 1–20 propylene oxide.

(4) Polyoxybutylene alkyl or alkylene ether having $C_{10}$–$C_{20}$ (average) alkyl or alkenyl group and added with 1–20 moles of butylene oxide.

(5) Nonionic surfactant having $C_{10}$–$C_{20}$ (average) alkyl or alkylene group, and added with 1–30 in sum of ethylene oxide and propylene oxide or butylene oxide (molar ratio of ethylene oxide to propylene oxide or butylene oxide is in the range of 0.1/9.9–9.9/0.1).

(6) Fatty acid alkanol amide of the formula (II) or alkylene oxide adduct thereof.

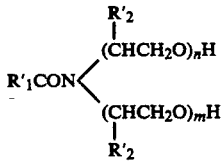

(II)

wherein $R'_1$ represents $C_{10}$–$C_{20}$ alkyl or alkenyl, $R'_2$ represents H or $CH_3$, or $n_1$ is an integer of 1 to 3, $m_1$ is an integer of 0 to 3.

(7) Fatty acid esters which are derived from $C_{10}$–$C_{20}$ (average) fatty acid and polyol (glycerine, sorbitol, sorbitan, pentaerythritol, sucrose), or polyalkylene oxide adduct thereof.

(8) Alkylamine oxide of the formula (III)

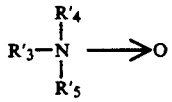

(III)

wherein $R'_3$ represents $C_6$–$C_{20}$ alkyl or alkenyl, $R'_4$ represents $C_1$–$C_3$ alkyl, hydroxyalkyl or polyoxyethylene chain having 2–7 moles of ethylene oxide, $R'_5$ is the same group as $R'_3$ or $R'_4$.

(9) Alkylglycoside of the formula (IV)

$$R'_6(OR'_7)_xG_y \qquad \text{(IV)}$$

wherein $R'_6$ represents straight or branched $C_8$–$C_{18}$ alkyl, alkenyl or alkylphenyl, $R'_7$ represents $C_2$–$C_4$ alkylene, G represents a radical derived from aldose having from 5 to 6 carbons, X is 0–5 on average, preferably 0–2, y is 1–10 average, preferably 1.1–3. Aldose having from 5 to 6 carbons includes glucose, fructose, maltose and sucrose.

(10) Polyethylene oxide adduct of polypropyelen glycol of which molecular weight of propylene glycol is 1000–4000 and average number of polyethylene oxide addition is 10–60.

Usually, these nonionic surfactants (a) having HLB of 6–19, preferably 8–17, are used. Among those, nonionic surfactant of groups (1), (2), (8) and (9) are preferably because of their detergency.

The amount of the nonionic surfactant (a) in the detergent composition is in the range of 1 to 90 weight percent.

Surfactant which can be used as (b) ingredient in the present invention is N-alkylamino sulfonic type surfactant of the formula (I).

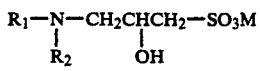

(I)

wherein $R_1$ represents $C_6$–$C_{18}$ alkyl, alkenyl or hydroxyalkyl, $R_2$ represents hydrogen, $C_1$–$C_{18}$ alkyl, alkenyl, hydroxyalkyl or $-(CH_2CH_2O)_n-H$ group (n is an integer of from 1 to 10), and M represents alkali metal, alkaline earth metal.

Examples of N-alkylamino sulfonic acid type surfactant (b) include (N-laurylamino)-2-hydroxypropane sulfonic acid salt, (N-stearylamino)-2-hydroxypropane sulfonic acid salt, (N-myristylamino)-2-hydroxypropane sulfonic acid salt, (N,N-dioctylamino)-2-hydroxypropane sulfonic acid salt) and (N-palmityl-N-trioxyethyleneamino)-2-hydroxypropane sulfonic acid salt. These compounds can be easily obtained by reacting an amine ($R_1R_2NH$) with 3-chloro-2-hydroxypropanesulphonic acid in the presence of alkali, and electrolytically dialyse the reaction product to get acid product (Japanese Laid-Open No. 63-69990).

In order to enhance the detergency effect aimed by the present invention, it is important to use (a) and (b) ingredient with the weight ratio of (a) to (b) in the range between 10/1 and 1/10, preferably between 10/1–1/5.

If the weight ratio is more than 10/1, improvement of detergency against the inorganic dirt is not sufficient. On the other hand, if the weight ratio is less than 1/10, detergency against the sebaceous dirt decreases.

A detergency against other inorganic dirt such as carbon black can be enhanced by incorporating an anionic surfactant as an ingredient (C) into the detergent composition of the present invention.

Preferable anionic surfactants (c) are illustrated below.

(1) Straight or branched alkylbenzene sulfonate having $C_{10}$–$C_{16}$ (average) alkyl group.

(2) Alkyl or alkenyl ether sulfate having straight or branched $C_{10}$–$C_{20}$ (average) alkyl or alkenyl group, and added with 0.5–8 moles (average) of ethylene oxide, propylene oxide, butylene oxide, ethylene oxide/propylene oxide (ratio=0.1/9.9–9.9/0.1) or ethylene oxide/butylene oxide (ratio=0.1/9.9–9.9/0.1).

(3) Alkyl or alkenyl sulfate having $C_{10}$–$C_{20}$ (average) alkyl or alkenyl group.

(4) Olefin sulfonate having $C_{10}$–$C_{20}$ (average).

(5) Alkane sulfonate having $C_{10}$–$C_{20}$ (average).

(6) α-sulfo fatty acid salt or ester salt of the following formula:

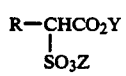

wherein Y represents $C_1$–$C_3$ alkyl or counter ion, and Z is counter ion. R represents $C_{10}$–$C_{20}$ (average) alkyl or alkenyl group. Examples of counter ion include alkali metal, alkaline earth metal and alkanolamine.

Among these, anionic surfactants of groups (1), (2), (4) and (5) are especially preferably.

It is preferable to use anionic surfactant (c) in an amount in which the weight ratio [(b)+(c)]/(a) is in the range of 1/10–10/1 and the weight ratio (b)/(c) is 1/20 or more.

Various components other than (a), (b) and (c) can be incorporated into the present detergent composition unless the component impedes the performance of the invention so as to make the composition aqueous fluid, non-aqueous fluid, paste, powder or bar detergent.

Components which can be incorporated are illustrated below.

(1) Hydrotrope

Ethanol, ethylene glycol, propylene glycol, propanol, lower alkyl benzene sulfonate such as p-toluene sulfonate, benzoic acid, urea, etc.

(2) Chelating agent

Zeolite, citric acid salt, citrate, ethylenediamine tetracetate, nitro triacetate, layered silicate, tripolyphosphate, etc.

(3) Alkali agent

Sodium carbonate, potassium carbonate, sodium silicate, alkanol amine, etc.

(4) Filler

Water, sodium sulfate, etc.

(5) Enzyme

Amilase, protease, cellulose, lipase, etc.

(6) Dispersing Agent

Acrylic acid polymer, maleic acid polymer, polyethylene glycol, carboxymethyl cellulose, etc.

(7) Bleaching Agent

Sodium percarbonate, sodium perborate, etc.

(8) Others

Fluorescence dye, perfume, colorant, preservative, etc.

The present invention is described in detail by way of the following examples. The present invention, however, is not limited to these examples.

EXAMPLE 1

Various detergent compositions shown in Table 1 were prepared, and were respectively evaluated with respect to their detergency by the method described below.

Cloth Soiled With Mud (Artificially Soiled Cloth)

Kanuma Akadama soils for horticulture use was dried at 120° C. ±5° C. for 4 hours and pulverized. After passed through 150 mesh (100 μm) sieve and dried at 120° C.±5° C. for 2 hours, 150 g of the soil was dispersed in 1 l of perchloroethylene.

After muslin #2023 cloth (standard) was dipped in the perchloroethylene solutions, the cloth was brushed to remove the solution and excess dirt attached (refer to Japanese Laid-Open No. 55-26473).

Cloth Soiled With Sebum and Carbon (Artificially Soiled Cloth)

Model compositions of sebum and carbon dirt

| | |
|---|---|
| Carbon Black | 15% |
| Cottonseed Oil | 60% |
| Cholesterol | 5% |
| Oleic Acid | 5% |
| Palmitic Acid | 5% |
| Liquid Paraffin | 10% |

One kg of the above composition was dispersed in 80 l of perchloroethylene. Muslin #2023 cloth was dipped in the perchloroethylene solution to be soiled, and was dried to remove perchloroethylene.

Washing Condition and Evaluation Method

Five pieces of cotton cloth (10 cm×10 cm) soiled with mud or sebum/carbon were respectively put into 1 l detergent aqueous solution, and then washed in a Terg-O-Tometer at 100 RPM. Washing condition is as follows:

| Washing Condition | |
|---|---|
| Washing Hours | 10 minutes |
| Concentration of Detergent | 0.133% |
| Hardness of Water | 4° |
| Water Temperature | 20° C. |
| Rinse | 5 minutes with city water |

Reflective (light) coefficients of an original cloth before being articially soiled, a soiled cloth before washing and a soiled cloth after washing were measured by self-recording colorimeter (manufactured by Shimazu Ltd.) at 460 μm.

Detergency was evaluated by means of detergency coefficient calculated by the following formula.

Detergency coefficient (%) =

-continued $$\frac{\text{Reflective Coefficient After Washing} - \text{Reflective Coefficient Before Washing}}{\text{Reflective Coefficient Of Original Cloth} - \text{Reflective Coefficient Before Washing}} \times 100$$

The results are shown in Table 1

TABLE 1

| CONSTITUENT (wt/%) | EXAMPLE 1 | 2 | 3 | 4 | 5 | 6 | 7 | 8 | 9 | 10 | 11 | COMPARATIVE 12 | 13 | 14 | 15 | 16 |
|---|---|---|---|---|---|---|---|---|---|---|---|---|---|---|---|---|
| (a) polyoxyethylene (EOp = 7) Lauryl ether | 4 | 10 | 20 | 30 | 36 | | 30 | | 25 | | | 38 | 2 | | 20 | 20 |
| polyoxyethylene (EOp = 2) Nonylphenyl ether | | | | | | 30 | | | | 20 | | | | 20 | | |
| Lauryl diglycoside | | | | | | | | 30 | | | 15 | | | | | |
| (b) Formula (I) $R_1 = C_{12-14}$ $R_2 = H$ $M = Na$ | 36 | 30 | 20 | 10 | 4 | | | | 10 | 10 | | 2 | 38 | | | |
| Formula (I) $R_1 = C_{16-18}$ $R_2 = H$ $M = Na$ | | | | | | 10 | | | | | 15 | | | | | |
| Formula (I) $R_1 = C_8$ $R_2 = C_8$ $M = Na$ | | | | | | | 10 | | | | | | | | | |
| Formula (I) $R_1 = C_{16}$ $R_2 = (CH_2CH_2O)_3—H$ $M = Na$ | | | | | | | | 10 | | | | | | | | |
| (c) Sodium Lauryl-Benzene Sulfonate | | | | | | | | | 5 | | 10 | | | 20 | 20 | |
| Sodium Polyoxy-Ethylene (EOp = 2) Lauryl Sulfate | | | | | | | | | 10 | | | | | | | 20 |
| Tallow Beef Fatty Acid Sodium Salt | | | | | | | | | | | | | | | 3 | 5 |
| Ethanol | 5 | 5 | 5 | 5 | 5 | 5 | 5 | 5 | 5 | 5 | 5 | 5 | 5 | 5 | 5 | 5 |
| Propylene Glycol | 15 | 15 | 15 | 15 | 15 | 15 | 15 | 15 | 15 | 15 | 15 | 15 | 15 | 15 | 15 | 15 |
| Water | B* | B | B | B | B | B | B | B | B | B | B | B | B | B | B | B |
| Detergency (%) Mud | 66 | 65 | 68 | 63 | 63 | 63 | 64 | 65 | 65 | 67 | 63 | 52 | 51 | 52 | 54 | 45 |
| Sebum/Carbon | 64 | 65 | 66 | 67 | 67 | 67 | 67 | 71 | 72 | 71 | 70 | 70 | 58 | 61 | 60 | 67 |

*B: Abbreviation of balance amount

EOp: Abbreciation of average molecule number of ethyleneoxide adducted

What is claimed is:

1. A detergent composition which consists essentially of (a) and (b), and weight ratio of (a) to (b) is in the range of 1/10 to 10/1, (a) nonionic surfactant in 1–90% by weight of the detergent composition (b) at least 4% by weight of the detergent composition of an N-alkylamino sulfonic acid type surfactant having the formula (I)

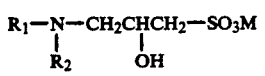

(I)

wherein $R_1$ is $C_6$–$C_{18}$ alkyl, alkenyl or hydroxyalkyl, $R_2$ is hydrogen, $C_1$–$C_{18}$ alkyl, alkenyl, hydroxyalkyl or —$(CH_2CH_2O)_2$—H group (n is an integer of from 1 to 10), and M is alkali metal or alkaline earth metal.

2. The composition of claim 1, which further consists essentially of (c) an anionic surfactant, selected from the group consisting of of the surfactants selected from the group consisting of alkylbenzene sulfonate, polyoxyethylene alkylether sulfate, olefin sulfonate and alkane sulfonate, and mixtures thereof and the weight ration [(b)+(c)]/(a) is in the range of 1/10–10/1 and the weight ratio (b)/(c) is 1/20 or more.

3. The composition of claim 1, wherein said (a) nonionic surfactant is one or more selected from the group consisting of polyoxyethylene alkylether, polyoxyethylene alkylphenyl ether and alkyl glycoside.

4. The composition of claim 2, where said (a) nonionic surfactant is one or more selected from the group consisting of polyoxyethylene alkylether, polyoxyethylene alkylphenyl ether and alkyl glycoside.

* * * * *